United States Patent [19]

Gorg

[11] Patent Number: 4,756,698

[45] Date of Patent: Jul. 12, 1988

[54] JET SYSTEM FOR SAILBOATS AND THE LIKE

[76] Inventor: Timothy J. Gorg, P.O. Box 18, LaCrescent, Minn. 55947

[21] Appl. No.: 779,477

[22] Filed: Sep. 25, 1985

[51] Int. Cl.[4] ..... B63B 35/02

[52] U.S. Cl. ..... 440/38; 440/39; 114/151

[58] Field of Search ..... 440/38–47, 440/3; 114/150, 151, 343; 138/44, 150, 122, 129; 136/291

[56] References Cited

U.S. PATENT DOCUMENTS

| | | | |
|---|---|---|---|
| 2,616,385 | 11/1952 | Woods | 440/38 |
| 2,960,958 | 11/1960 | Doulgheridis | 440/38 |
| 3,102,389 | 9/1963 | Pedersen | 440/43 |
| 3,155,065 | 11/1964 | Strumskies | 440/38 |
| 3,342,032 | 9/1967 | Cox | 440/38 |
| 4,102,291 | 7/1978 | Sebald | 114/244 |
| 4,344,462 | 8/1982 | Aubert | 138/150 |
| 4,392,063 | 7/1983 | Lindquist | 290/52 |
| 4,553,037 | 11/1985 | Veasey | 136/291 |

FOREIGN PATENT DOCUMENTS

| | | | |
|---|---|---|---|
| 3423963 | 1/1986 | Fed. Rep. of Germany | 343/ |
| 2484356 | 12/1981 | France | 136/291 |

*Primary Examiner*—Joseph F. Peters, Jr.
*Assistant Examiner*—Clifford T. Bartz
*Attorney, Agent, or Firm*—Richard L. Miller

[57] ABSTRACT

This invention is a hydraulic auxiliary power system for a sailboat, and includes a sea-water-driven turbine pulling water from ahead of the hull and forcing it behind the rear of the hull; the turbine being powered by solar energy.

4 Claims, 1 Drawing Sheet

Fig. 1
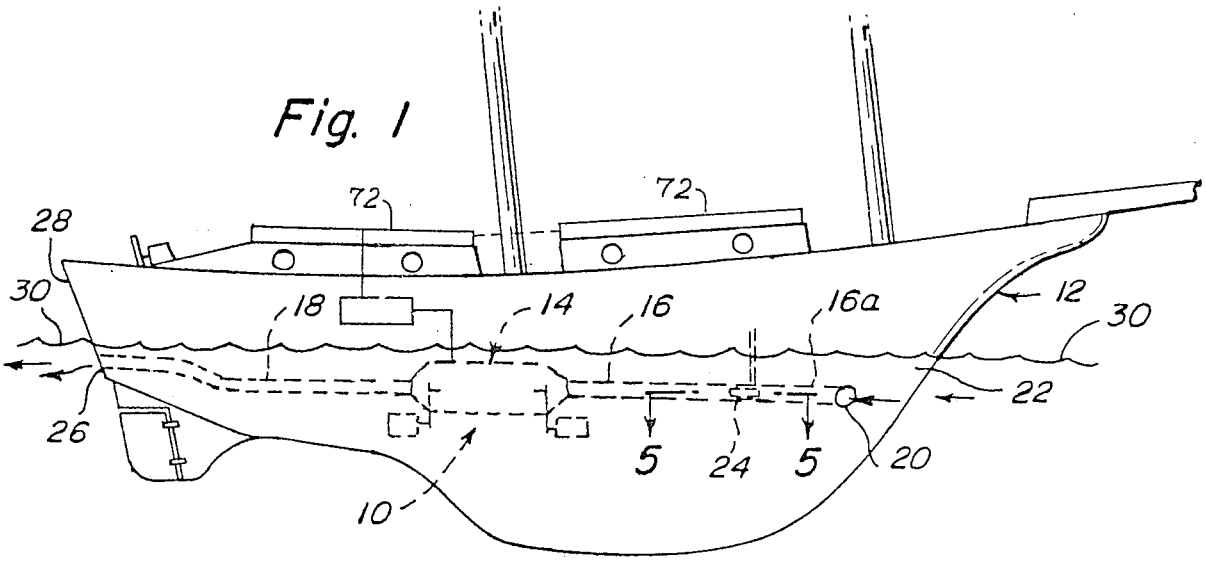
Fig. 2
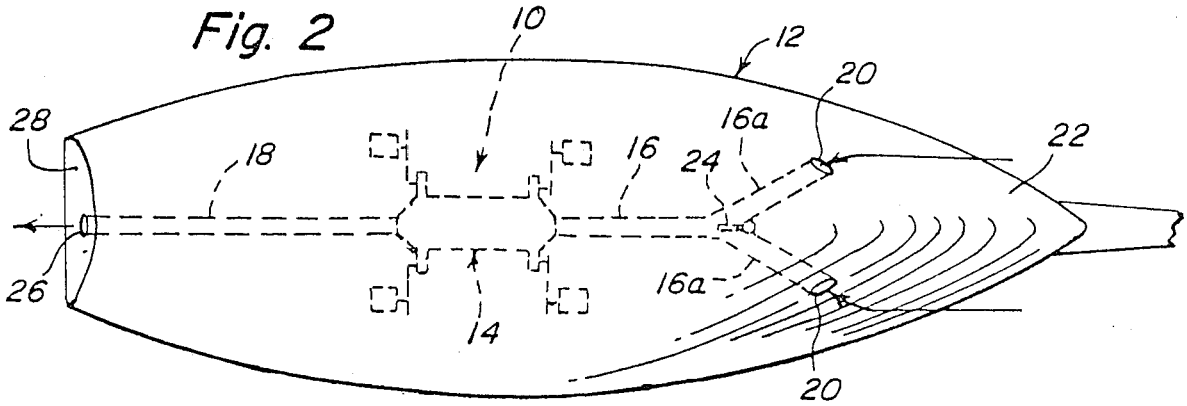
Fig. 3
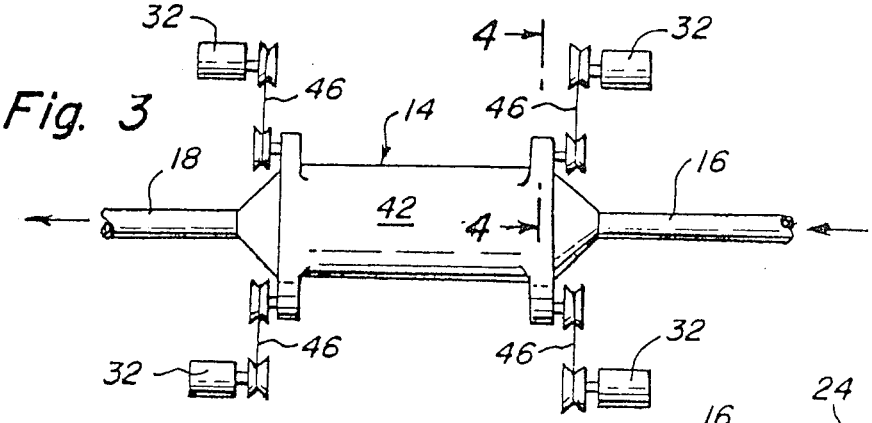
Fig. 4
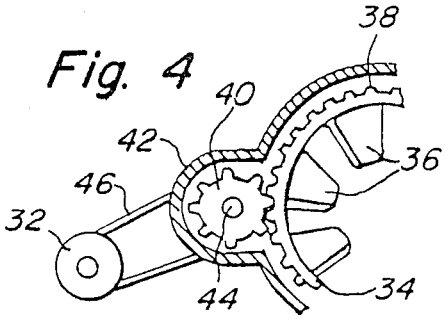
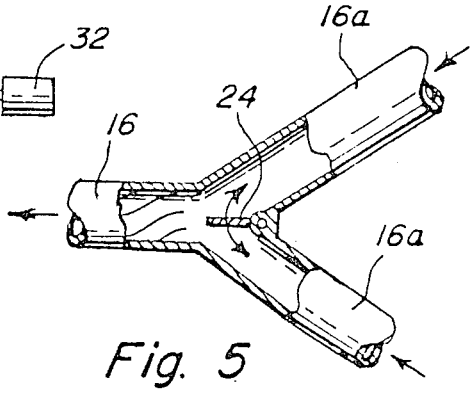
Fig. 5

JET SYSTEM FOR SAILBOATS AND THE LIKE

BACKGROUND OF THE INVENTION

This invention relates generally to sailboats. More specifically it relates to auxiliary power system for sailing vessels.

It is well known that most sailboats of larger than the one man catboat variety, are provided with auxiliary engines so as to be able to travel if there is insufficient wind for the sails. Such engine is provided by gasoline and has the objection of polluting the environment, being noisy and causing unpleasant vibration felt aboard. This situation is accordingly in need of an improvement. While various U.S. Pat. Nos. such as 3,411,013; 4,102,291; and 4,392,063, have been granted for invention relating to jet systems non are as suitable for the intended purpose as is the instant invention.

SUMMARY OF THE INVENTION

Therefore it is a principal object of the present invention to provide an all electric sailing vessel wherein the auxiliary power is derived from solar energy, so that it carries no gasoline or diesel fuel, eliminating fuel costs, fire hazards, fossil fuel odors and wasted space for fuel storage; the vessel carrying only solar panels, batteries and a turbine instead.

Another object is to provide a sailboat auxiliary system wherein the turbine jets pressurized water from the vessel rear, thus eliminating a rudder and increasing the hull speed through the water while decreasing pressure resistance from forward.

Another objects are to provide a jet system for sailboats or the like which is simple in design, inexpensive to maintain and easy to operate.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a side elevational view of a boat shown incorporating the present invention.

FIG. 2 is a bottom plan view thereof.

FIG. 3 is an enlarged detail of the power take off system shown in FIG. 2.

FIG. 4 is an enlarged partial broken cross sectional view taken on line 4—4 of FIG. 3.

FIG. 5 is an enlarged partial broken cross sectional view taken on line 5—5 of FIG. 1, illustrating the intake refilling venturi "Y" pipe and bow rudder butterfly valve.

DETAILED DESCRIPTION OF THE PREFERRED EMBODIMENT

Referring now to the Drawing in greater detail, the reference numeral 10 represents a jet system for a sailboat 12 or the like, and which is powered by a conventional solar energy collector 40 and which may be installed with the energy collector 72 mounted on the cabin roof while a remainder of the system is below deck. The collector 40 producing electrical energy to power an electric motor can be a single unit if desired and in turn drives an inboard hydraulic turbine 14 having a rotor carrying a plurality of impeller blades. A water supply pipe 16 is connected to a forward end of the turbine for delivering a water supply to the turbine, and a water discharge pipe 18 is connected to a rear end of the turbine for removal of the water therefrom.

The forward end of the turbine intake pipe 16 is bifurcated into branch lines **16*a* each of which has an intake port opening 20 for receiving sea water near the bow 22 of the boat, one being on the port side and the other on the starboard side. A manually controllable butterfly valve 24 at the junction of the branch lines 16*a* and the pipe 16** serves for selectively varying the proportion of water permitted to pass from either branch line to the turbine.

The rear end of the discharge pipe has an exhaust jet 26 which exits through the boat stern 28.

Both of the intake ports and the exhaust jet are located below the water surface 30 of the sea, so that in operative use, water from the forward of the boat is forcibly pushed against the sea water behind the boat. This results in a decreasing resistance pressure against the front of the boat's hull and an increased pressure against the rear of the hull, thus causing the boat to travel ahead at significant speeds. The rotor impeller blades force the water rearwardly through the turbine, and steering of the vessel is accomplished by controlling the butterfly valve 24.

A plurality of generators 32 may be driven by the turbine for performing other services aboard such as furnishing electric power to the boat's lighting system, galley stove, hot water heater, radio communication system and the like.

As shown in FIG. 4, the tubular rotor 34 has inwardly coaxial convergent impeller blades 36 that force the sea water rearwardly. Gear teeth 38 around the rotor engage gear 40 also located inside the turbine housing 42, and affixed on shaft 44 extending outwardly of the housing and having a chain or pulley drive 46 affixed thereto for driving each of the generators.

As shown in FIG. 5, it is desirable to spirally riffle the turbine intake pipe 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A jet system for sailboats, comprising, in combination, a water turbine inside a boat hull, a water intake pipe from a bow of said hull to said turbine, a water exhaust pipe from said turbine to a stern of said hull for sea water to be forced therethrough, wherein said water intake pipe is bifurcated into two inlet branch lines respectively coupled to the port side and the starboard side of the sailboat, a butterfly valve connected at the junction of said branch lines, control means for controlling the butterfly valve to selectively vary the proportion of water permitted into the branch lines to thereby steer the sailboat, solar collector panels mounted on the sailboat for collecting solar energy and a solar energy collector coupled to said turbine whereby said solar energy is the primary power means of said turbine.

2. The combination as set forth in claim 1, wherein a plurality of generators are powered by said turbine.

3. The combination as set forth in claim 2, wherein at least one water passage of said system is spirally riffled.

4. The combination as set forth in claim 2, wherein said turbine comprises a rotor, gear teeth directly connected around a periphery of the rotor and a plurality of satellite gears meshing with said gear teeth, said satellite gears operating said generators.

* * * * *